United States Patent [19]

Jian

[11] Patent Number: 4,940,230

[45] Date of Patent: Jul. 10, 1990

[54] UNIVERSAL HANDLE

[76] Inventor: Du Jian, No. 120 Xidajie Gulou Xichengqu, Beijing, China

[21] Appl. No.: 193,930

[22] Filed: May 13, 1988

[51] Int. Cl.[5] ..... A63B 59/04

[52] U.S. Cl. ..... 273/76; 273/75; 273/73 J

[58] Field of Search ..... 273/73 J, 75, 76, 72 R, 273/81 R, 81 A, 81 B; 16/110 R, 112

[56] References Cited

U.S. PATENT DOCUMENTS

| | | | |
|---|---|---|---|
| 259,448 | 6/1882 | Woodhouse | 273/75 |
| 1,261,638 | 4/1918 | Southwell | 273/76 |
| 1,528,648 | 3/1925 | Armstrong | 273/81 B |
| 1,535,667 | 12/1922 | Horne | 273/81 B |
| 1,591,363 | 7/1926 | Cowdery | 273/81 B |
| 1,841,688 | 1/1932 | Velchek | 273/81 R |
| 1,860,561 | 7/1930 | Warner | 273/75 |
| 1,979,460 | 11/1934 | Forsberg | 273/75 X |
| 2,871,899 | 2/1959 | Coyle et al. | 273/81 R |
| 3,606,327 | 9/1971 | Gorman | 273/81 A |
| 3,770,033 | 11/1973 | Gavillet | 273/73 J |
| 4,072,312 | 2/1978 | Kahn | 273/75 |
| 4,828,261 | 5/1989 | Kleylein | 273/75 |

FOREIGN PATENT DOCUMENTS

| | | | |
|---|---|---|---|
| 20180 | of 1904 | United Kingdom | 273/81 A |

*Primary Examiner*—Edward M. Coven
*Assistant Examiner*—William E. Stoll
*Attorney, Agent, or Firm*—Ladas & Parry

[57] ABSTRACT

A handle for various sport articles, especially for various bats, rackets and swords, is disclosed, which comprises a spheroid (1) with circular or other curved outline is disposed transversely at the upper portion of the handle, a half spheroid (3) being jointed to the lower portion of the spheroid (1) through a slender neck (2), a cylindroid (4), a prism (5) with cross-shaped section and a gravity-center adjusting device (6). The connection between the handle and the other part of the racket is in such a manner that the long axis of the section of the handle is perpendicular to the racket surface. The handle of this invention had advantages of nimbleness and having strength.

6 Claims, 4 Drawing Sheets

UNIVERSAL HANDLE

BACKGROUND OF THE INVENTION

The persent invention relates to universal handles for sports articles, more particularly to the handles of rackets, bats swords or the like.

The known handles of various sports articles are substantially sticklike. For example, the handle of tennis racket or badminton racket is often shaped into elongated stick with octagonal section. There are no grooves on the surface of the handle to help a player rotate the racket by his fingers, so the player cann't change the orientation of the racket surface rapidly. Furthermore, the racket may be slipped forward from a player's hand when the player changes his thumb from resting on the handle sideward into pressing on it. Thus the racket tends to be slipped out of the player's hand during the game. When a player applies force through his palm, the contacting area of the palm with the handle is quite large so that there are no distinct force-applying points and directions. A player must use both sides of the racket surface for forehand stroke and backhand stroke repectively because the long aocis of the section of the hand is disposed to be parallel to the racket surface and the player can only grip the racket sideward.

As the result, the player can't adjust the orientation of the racket surface rapidly because his finger's movement for this adjustment is relatively large. Since the gravity-centre of the racket is much near the top end of it, a player has to use the upper portion of the handle as a major force-applying area so that he cann't apply force on it by his palm and leaves the lower portion free within his palm.

The known configurations of the handle of table tennis bat have a disadvantage that the orientation of the bat can hardly be stable because a player's thumb and index finger extend into the bat surface in order to adjust the orientation of it and to increase flexibility. Nevertheless, the adjustment of the orientation of the bat is confined within a small range between the thumb and index finger. Other disadvantages are just as same as that existed in the case of tennis racket or badminton racket.

SUMMARY OF THE INVENTION

In order to overcome the above mentioned disadvantages existed in various handles, the object of the present invention is to provide a new handle for sports articles which will be more rational in structure, enable a player to use the strength and nimbleness of his fingers and wrist.

The handle of the present invention consisits of a spheroid (1) with an outline of circle or any other curves, which is transversely disposed at the upper portion of the handle; a half-spheroid (3) with an elliptical or circular cross-section, which is longitudinally disposed and jointed to the said spheroid (1) through a slender neck (2); a cylindroid (4) (or column); a prism (5) with a cross-shaped section (may be regular or flat); and an adjusting device (6) for adjusment of the centre of gravity. At the joint between the handle and the other part of the racket, the handle is disposed in such a manner that the long axis of its cross-section is perpendicular to the racket surface, corresponding to 90° rotation of the handle in the case of ordinary racket (wherein the long axis is parallel to the racket surface).

For the table tennis bat, a curved revolving body (7) is disposed above the spheroid (1), and a portion of the bat adjacent to the joint which is in the way of the rotation of the handle by the fingers is removed.

The gravity-centre adjusting device (6) is made of metal sheets, such as gold, silver, copper, iron or tin, which are disposed at the bottom of the handle to change the weight of it, hence the gravity-centre of the racket.

The function of every part will be explained therein after. The spheroid (1) enable a player to rotate the racket freely by his fingers, cooperated with the wrist, so that the orientation of the racket can be varied as desired. The spheroid (3) enable the racket to be held tightly by the thumb, index finger and middle finger. The top of the thumb is just against the side of the spheroid (1) when the racket neck is turned by the thumb for a backhand stroke, so as to keep the thumb from slipping forward. The racket can hardly be slipped out of the hand during the game because the racket neck (2) is gripped by the thumb and index finger and the spheroid (1) and the expanding portion of the spheroid (3) prevent those figers from slipping forword or backward respectively. The cylindroid acts as a transition between the spheroid (3) and the prism (5) and rotates together with the handle.

The palm of the hand is engaged with the prism (5), so as to increase the holding force. Because the long axis of the cross-section of the handle is perpendicular to the racket surface, a player can either hold the racket sideward or frontward so that the player can use either one side or both sides of the racket for a backhand or forehand stroke at suitable strength and speed. Also, the removal of the portion (8) enables the handle of this invention to be used in table tennis bat. The stability of the orientation of the bat is enhanced because there is provided a curved revolving body (7) to make the fingers grip it tightly. The gravity-centre adjusting device (6) is adopted to lower the gravity-centre and the major force-applying area to the rear portion of the racket so that a player can use his palm to exert force on the handle and reduce the force exerted by the fingers gripping at its front. In this way, the player can not only control the racket nimblely but also put forth a sudden strength by his palm at the momnet of a stroke.

DESCRIPTION OF THE PREFERRED EMBODIMENT

Figures 1, 2, 3:
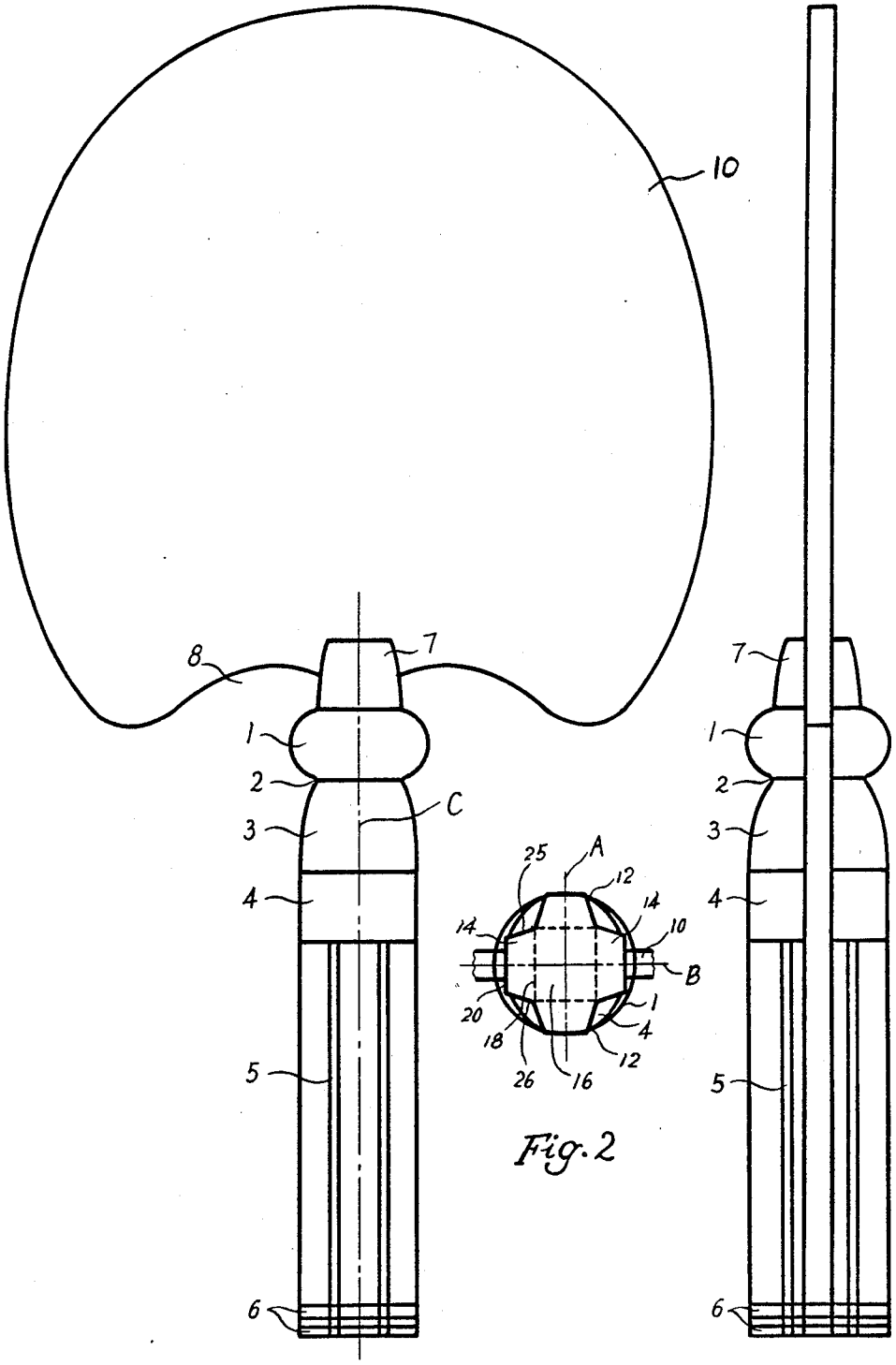
FIG. 1 is a front view of a table tennis bat according to this invention.
FIG. 2 is a bottom view of th handle of the bat of FIG. 1.
FIG. 3 is a side view of the bat handle of FIG. 1.
Figure 4:
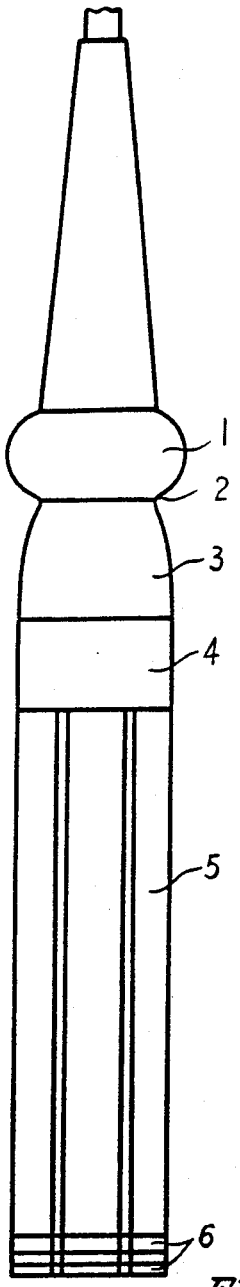
FIG. 4 is a sectional view of the bat handle taken along the line I—I in FIG. 1.
Figure 5:
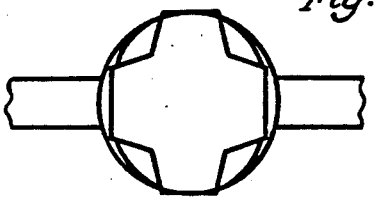
FIG. 5 is a front view of a handle of badminton racket according to this invention.
Figure 6:
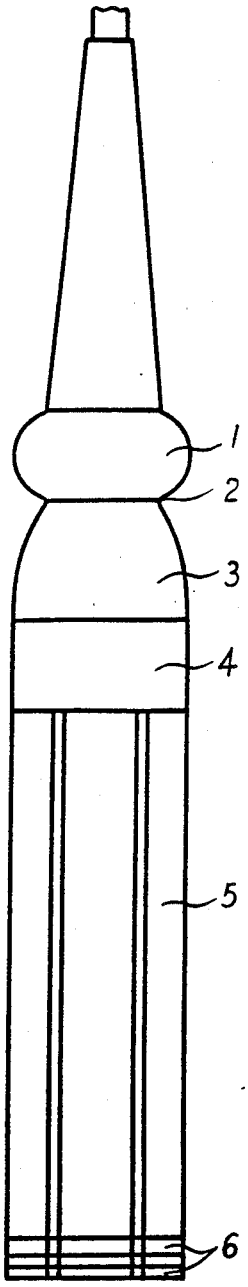
FIG. 6 is a bottom view of the handle of the racket of FIG. 5.
Figure 7:
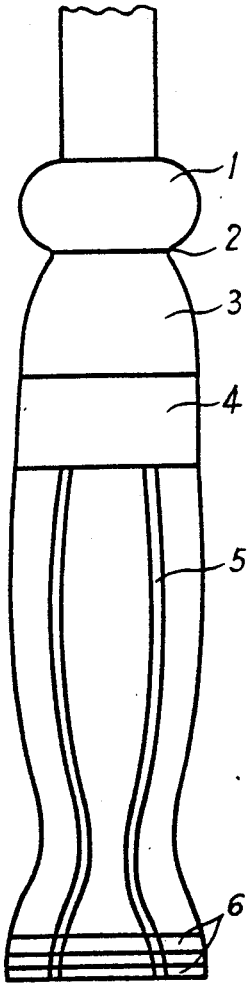
FIG. 7 is a side view of the handle of the racket of FIG. 5.

Referring now to the drawings, especially to FIG. 1 to FIG. 3 thereof, a handle is seen to consist of a transversely disposed spheroid (1) with an outline of circle or any other curves at the upper portion of the handle; a curved revolving body (7) being disposed above the spheroid (1); a half spheroid (3) is jointed to the lower portion of the spheroid (1); a cylindroid (4); a prism (5) with cross-shaped section; and a gravity-centre adjusting device (6). the joint between the handle and the bat is so arranged that the long axis of the section of the handle below the neck (2) is perpendicular to the bat surface. A portion of the bat whcih restricts the rotation of the handle is removed.

The diameter of the spheroid (1) is about 20 to 40 mm, and its hight is over 8 mm. The diameter of the half spheroid (3) at the neck (2) is from 16 to 26 mm. The lengths of the narrow sides of the bottom of spheroid (3), the cylindroid (4) and the prism (5) with a cross-shaped section are all about 20 mm, and the lengths of the wide sides of them are about 40 mm. The cross-shaped prism (5) is constructed by two forms. The one is two groups of ridges with opposite and same isosceles trapzoid. The relative distance between two narrow sides is about 20 mm. The relative distance between two wide sides is about 40 mm, the another is four same ridges of isosceles trapzoid, the relative distances between each two opposite sides are from 20 m to 40 mm. The lengths of them is arbitrary. The hight of each trapeze is over 4 mm, and the width of each top of the trapezes is over 5 mm.

The shape of the curved revolving body (7), the cylindroid (4) and the ridges of the cross-shaped prism (5) may be varied. The horizontal outline of the spheroid (1) may be elliptical slightly. The edges of the prism (5) may be dulled by polishment, the concare between every two ridges of the prism should enable a part of the palm to get into it and to apply force on the sides of the isosceles trapezoids. The neck (2) between the two spheroids (1) and (3) should be in such a form that the thumb and index finger can apply forward or backward force on the spheroids (1) or (3) respectively without any displacement, the removed portion (8) enables the spheroid (1) to be rotated by the thumb, index finger and middle finger nimblely.

The handle may be made either by bonding all its parts in series or by forming them integrally. The surface of the handle may be convered with any suitable antislip materials, such as leathers, plastics or the like, or made in criss-cross-structure of convex alternating with concave. The handle with circular section comprises a spheroid (1), a half spheroid (3), a column (4), a prism (5) with regular cross-shaped section and a gravity-centre adjusting device (6) in series parts of them may be chosen to form the handle of this invention, such as [(1)+(2)+(3)+(4)+(6)] or [(4)+(5)+(6)], as referred to its simple forms.

Figure 9:
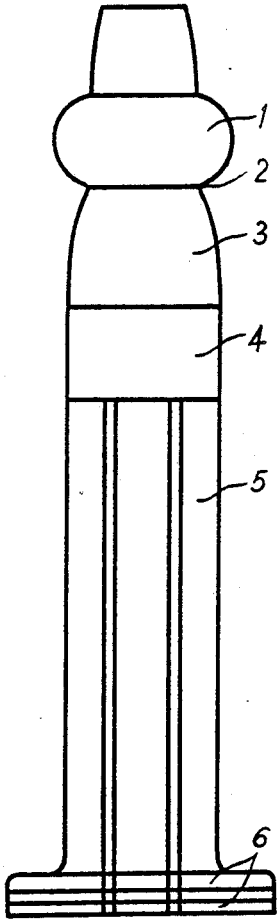
FIG. 9 is a side view of the racket handle which is slightly bent at its end portion.
Figure 8:
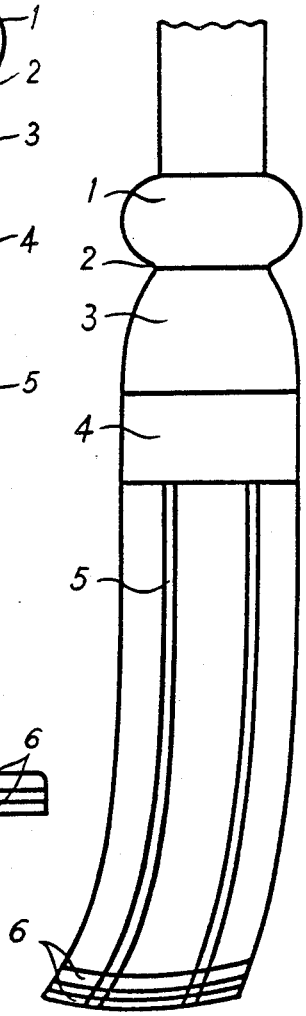
FIG. 8 is a side view of the racket handle with the outline of fish belly.
Figure 10:
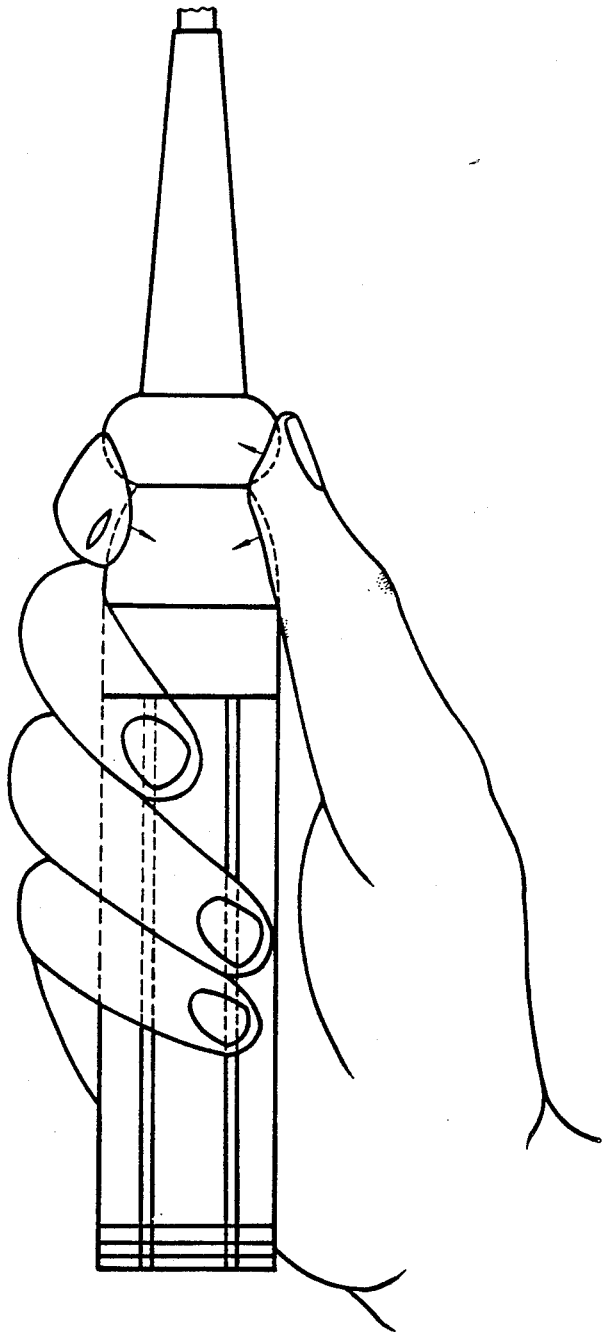
FIG. 10 is a front view of the racket handle which is expanded at its bottom.

The part below the neck (2) may be shaped into the form having narrow top and wide end or into fish's belly (FIG. 8), or bent slightly (FIG. 9), or expanded slightly at its bottom (FIG. 10), instead of being stick-like. The configuration of the gravity centre adjusting device (6) and the means of adjusting thereof can be varied. The adjusting member can be disposed at the bottom directly, or hidden inside the handle. The material of the adjusting member, and its size, configuration and weight can be varied. Preferably, it has the same shape as that of the cross-shaped prism. The adjustment may be effected by screwing, adhering or absorbing the adjusting member on the handle. The screwing manner is preferable. The variations of the materials, sizes and the ratio between the parts of the handle will become apparent to those skilled in the art, and it is intended to cover in the appended claims all such variations as come within the spirit and scope of this invention.

What is claimed is:

1. A handle for a sports racket, the handle being elongated and comprising, along the axis of elongation of the handle, a truncated spheroid disposed at an upper portion of the handle; a truncated ellipsoid of increasing cross-sectional dimensions from top to bottom joined to the lower portion of said spheroid at a slender neck; said neck defining the bottom of a groove extending around said handle, the groove bottom lying in a plane perpendicular to said axis of elongation, and the walls of said groove comprising convex surfaces of said spheroid and said ellipsoid; a cylindroid joined to the bottom portion of said ellipsoid; and a prism; joined to the bottom of said cylindroid the axial lengths of said cylindroid and said ellipsoid being such that, in use, the user's palm can grip said prism with the user's thumb and index finger each engaging both convex walls of said groove for preventing forwards or backwards slippage of the handle in the user's hand.

2. A handle according to claim 1 wherein said prism has a cross-shaped cross section including two pairs of oppositely extending ridges, adjacent pairs of said ridges defining a groove large enough to admit entry therein of a portion of the palm of the user for applying force on the side of one of said ridges.

3. A handle according to claim 2 wherein said prism comprises a central, rectangular core, and each of said ridges extends from one side of said core, each of said ridges having a cross-section in the shape of an isosceles trapezoid, a base of each trapezoid being joined to a corresponding one of said core sides, and the side of each trapezoid opposite said base thereof being parallel to said base and of a length shorter than that of said base.

4. A handle according to claim 1 including a flat racket head attached to said handle, and wherein the cross-sections of said ellipsoid and said cylindroid in planes perpendicular to the axis of elongation of the handle are ellipses, the major axes of said ellipses being perpendicular to the major surfaces of said racket head.

5. A handle according to claim 3 wherein the diameter of said spheroid is from 20 to 40 mm, the cross-sections of said ellipsoid and said cylindroid at the joint therebetween being identical and in the shape of an ellipse, the dimension along the major axis of the ellipse being about 44 mm and the dimension along the minor axis of the ellipse being about 20 mm, the height of said prism trapezoids, in a direction perpendicular to the bases thereof, being over 4 mm and the lengths of the sides opposite and parallel to the trapezoid bases being over 5 mm.

6. A handle according to claim 1 for use only with either a table tennis bat or a badminton racket.

* * * * *